United States Patent [19]

Hake

[11] 4,090,322

[45] May 23, 1978

[54] GEOMETRIC AMUSEMENT SET

[75] Inventor: David Frederick Hake, 832 Glenstone Ct., Trotwood, Ohio 45426

[73] Assignee: David F. Hake, Trotwood, Ohio

[21] Appl. No.: 736,545

[22] Filed: Oct. 28, 1976

[51] Int. Cl.[2] ..... A63H 33/10

[52] U.S. Cl. ..... 46/25; 46/30

[58] Field of Search ..... 46/16, 17, 21, 23, 24, 46/25, 26, 30, 31; 273/160, 156, 157 R; 35/27, 72, 73; 428/33

[56] References Cited

U.S. PATENT DOCUMENTS

| | | | |
|---|---|---|---|
| D. 234,791 | 4/1975 | McAllister | D34/15 GG |
| 1,268,391 | 6/1918 | Schepmoes | 35/72 |
| 1,880,130 | 9/1932 | Goldbach | 273/156 |
| 2,020,562 | 11/1935 | Miller | 46/11 |
| 2,776,521 | 1/1957 | Zimmerman | 46/25 |
| 3,611,617 | 10/1971 | Foster et al. | 46/1 L |
| 3,666,607 | 5/1972 | Weissman | 428/33 |
| 3,819,188 | 6/1974 | Freedman | 273/160 |

FOREIGN PATENT DOCUMENTS

| | | | |
|---|---|---|---|
| 1,903,159 | 10/1970 | Germany | 46/23 |
| 2,338,936 | 2/1975 | Germany | 46/19 |
| 664,998 | 1/1952 | United Kingdom | 46/17 |
| 1,378,942 | 1/1975 | United Kingdom | 46/30 |

OTHER PUBLICATIONS

Tri Logic, No. 233; Mag-Nif, Inc., Mentor, Ohio, 1975.

*Primary Examiner*—Louis G. Mancene
*Assistant Examiner*—Mickey Yu
*Attorney, Agent, or Firm*—Biebel, French & Nauman

[57] ABSTRACT

A geometric building and amusement set comprising a plurality of similar block-like pieces each having a generally triangle cross section. The set has three distinctly shaped pieces: a first group of pieces having a generally rectangular male connector formed on one side, a generally rectangular female connector recess formed in another side and proportioned to accept a male connector of an adjacent piece; a second group of pieces formed with only one male connector on one side; and a third group of pieces formed with only the female connector recess on one side. Protuberances are provided on the end portions of the female connector recesses which mate with corresponding recesses formed in the corresponding ends of the male connectors of mating pieces.

1 Claim, 10 Drawing Figures

GEOMETRIC AMUSEMENT SET

BACKGROUND OF THE INVENTION

1. Field of the Invention

This invention relates to a geometric building and amusement set and more particularly, to a building and amusement set using a plurality of block-like pieces to form larger three dimensional geometric forms.

2. Prior Art

There are many prior art building construction blocks of the type contemplated by the present invention which basically utilize a plurality of generally equilateral cross sectioned, relatively flat pieces to construct a larger two or three dimensional geometric configuration.

Such devices all require some means of interconnecting the pieces in order to maintain them in position to form the larger geometric configuration. This has been accomplished in a variety of ways in the prior art devices such as, for example, by the use of tabs and corresponding slots in adjacent surfaces of adjacently disposed pieces, or by the use of hinges which protrude from the side surfaces of the pieces with mating removable hinges protruding from the sides of adjacent pieces so that they may be coupled together.

Such devices, however, do not permit of assembly in such a manner as to produce an outside edge on the two or three dimensional construction which is smooth, since all of the sides of each piece have connecting means of some sort thus giving an unesthetically pleasing appearance and one which may interfere with the intended visual presentation of the geometric construction.

SUMMARY OF THE INVENTION

The present invention overcomes the above described disadvantages associated with prior art devices by providing a set of building and amusement pieces of slightly varying geometry which permit a geometric two or three dimensional figure to be constructed with externally smooth side surfaces while permitting flexibility in construction due to the particular hinge arrangement utilized.

These advantages are accomplished by providing a set of similar block-like pieces each having a generally triangular cross section, but the set having three distinctly shaped groups of pieces. A first group of pieces has formed on one side thereof and extending for a major portion along that side, a generally rectangular male connector with a generally rectangular female connector recess formed in another side and proportioned to accept a male connector of an adjacent piece. A second group of pieces are formed with only the male connector on one side, and a third group of pieces are formed with only the female connector recess on one side.

The set of pieces are pivotally releasably joined together with hinge means extending between the male and female connectors of adjacent pieces. This can be accomplished, for example, by the use of protuberances extending from the end portions of the female connector recesses and corresponding recesses formed in the corresponding end portions of male connectors.

The protuberances are perferably cylindrical or hemispherical in shape and the corresponding recesses are likewise cylindrical or hemispherical, so that the recess will completely encompass the protuberance when the pieces are assembled. The blocks are preferably made of a semi-rigid material which will give sufficiently to permit assembly of protuberances in the corresponding recesses.

DETAILED DESCRIPTION OF THE PREFERRED EMBODIMENTS

Figure 1:
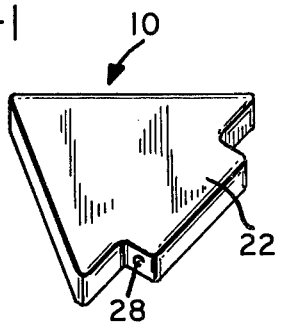
FIG. 1 is a pictorial illustration of one piece in a set of a preferred embodiment of the present invention.
Figure 2:
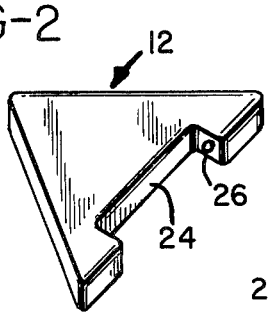
FIG. 2 is a pictorial illustration of a second piece in a set of the preferred embodiment of the present invention.
Figure 3:
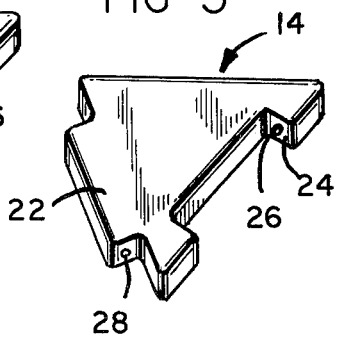
FIG. 3 is a pictorial illustration of a third piece in a set of the preferred embodiment of the present invention.
Figure 4:
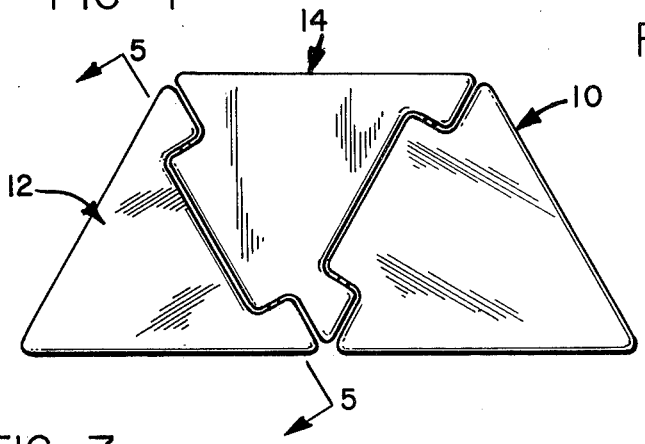
FIG. 4 is a top plan view of an assembly of the pieces of FIG. 1–3 to form a two-dimensional geometric figure.

In FIGS. 1–3 are illustrated the three basic forms of pieces 10, 12 and 14 respectively, comprising a set of the preferred embodiment of the present invention. Pieces 10, 12 and 14 have a basic similar construction in that they are all generally formed with upper and lower parallel surfaces such as 16 and 18 shown in FIG. 5, and having interconnecting side edges such as 20. The pieces are preferably formed with an equilateral triangular cross sectional shape, although the use of other simple geometric shapes such as isosceles triangles, squares or rectangles, may be utilized. However, it is well known that the equilateral triangle will permit a greater number of geometric forms to be built from the basic pieces that will other simple geometric forms in which the pieces might be formed, and it is therefore believed to be the preferred form.

Figure 10:
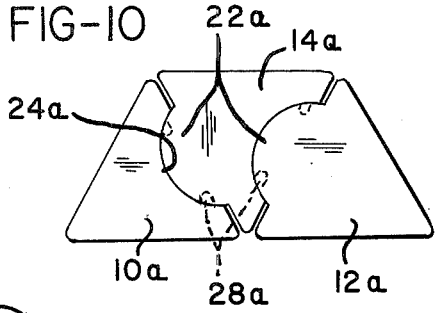
FIG. 10 is a top plan view of an assembly of pieces of an alternative embodiment of the present invention.

The basic construction piece forming a set of blocks of the preferred embodiment of the present invention is illustrated in FIG. 3 as piece 14. Piece 14 has a generally rectangular male connector 22 formed in one side of the piece and a generally rectangular female recess 24 formed in another side of the piece which is so proportioned as to matingly engage an adjacent male connector 22 of another piece, such as piece 10 illustrated in FIG. 1. The third side of piece 14 is smooth and can be used as an outside edge in either of two or three dimensional geometric configuration. Although the generally rectangular male connector 22 and the corresponding female recess 24 are the preferred form of connection, it is to be understood that other forms may be used so long as they provide a recessed portion and a protruding portion which extend along the side of a piece a sufficient distance to provide a stable hinge connection. For example, a semi-circular connector and a corresponding recess, as shown in FIG. 10 may be used as an alternative form of connection.

The piece 12 illustrated in FIG. 2 has a female connector recess 24 formed in one side thereof with the remaining two sides being smooth. The piece 10 has a male connector 22 formed in one side thereof and the other two sides of the piece are smooth.

In order to interconnect pieces 10, 12 and 14 so as to be removably rotatably hinged together in order to form a two or three dimensional larger geometric figure, a hinge means is provided. The hinge means preferably comprises a pair of protuberances 26 formed in the ends of the recesses of the female connectors 24 and corresponding recesses 28 having either a cylindrical or hemispherical form corresponding to the form of protuberances 26, so that the male connector 22 may be releasably hingably engaged in the female connector recess 24 and remain held there by protuberances 26 extending into the recesses 28.

Although this is the preferred form of hinging, particularly when the pieces are formed of semi-rigid plastic material such as polypropylene polyethlene, polyvinyl, and the like, it is to be understood that other connection means may be utilized. For example, a bore could be made extending through the male connector from end to end and a corresponding bore formed in the outer legs 30 of a piece where the female connector recess 24 is formed so that a hinge pin (not shown) may be inserted through the bores to hingably connect adjacent pieces together. Such an alternative would be particularly useful where a rigid material is utilized to form the pieces, such as wood or metal, since the protuberances 26 would not be sufficiently deformable when made from such materials to permit then to be inserted into the corresponding recesses 28.

Figure 7:
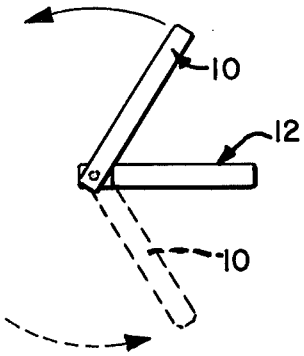
FIG. 7 is a side plan view of two connected pieces of the preferred embodiment of the present invention, illustrating the total angular movement between the two pieces.

The male connectors 22 and corresponding female connector recesses 24 are so connected and arranged as to permit substantial relative movement between connected adjacent pieces, for example, of more than 180°, as is illustrated in FIG. 7.

Figure 5:
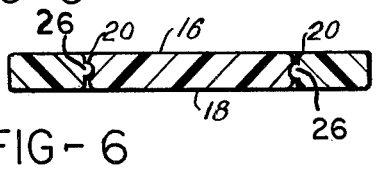
FIG. 5 is a cross sectional view along line 5—5 of FIG. 4.
Figure 6:
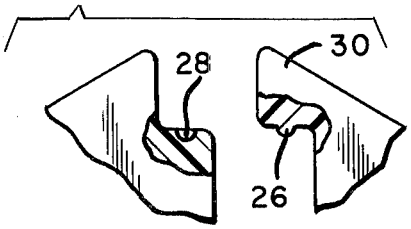
FIG. 6 is an expanded plan view in particular cross section of a portion of two pieces of the preferred embodiment, illustrating the protuberance and corresponding recess for connecting adjacent pieces together.
Figure 8:
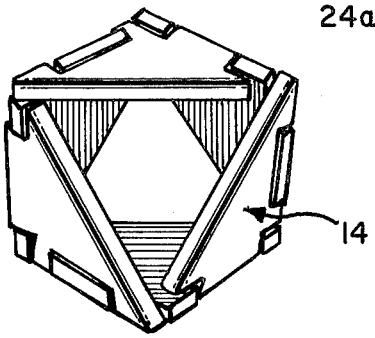
FIG. 8 is a pictorial illustration of a plurality of pieces forming a set of the preferred embodiment of the present invention, constructed into a three dimensional geometric configuration.
Figure 9:
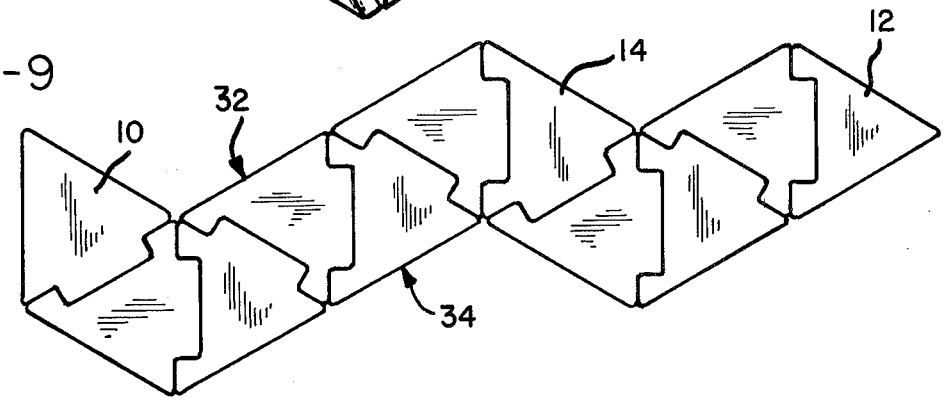
FIG. 9 is a top plan view of a two dimensional assembly of pieces forming a set of the preferred embodiment of the present invention.

With the three distinct pieces 10, 12 and 14 forming a set of the preferred embodiment of the present invention, it is possible to construct a multi-piece geometric formation such as illustrated in FIGS. 8 and 9 with substantially smooth external surfaces around the entire periphery, such as surfaces 32 and 34 of the construction shown in FIG. 9. With the hinge means of the preferred embodiment of the present invention it is possible to easily assemble and disassemble such geometric forms to produce other geometric forms from the pieces. It is contemplated that the majority of pieces in a given set would preferably be of the construction illustrated in FIG. 3 with a minority of the pieces of the construction of FIGS. 1 and 2, which are generally used as end pieces as shown in FIG. 5.

The pieces may, likewise, be constructed in any size from the small forms which can be utilized by children for constructive education and amusement in producing geometric forms, to sizes which would permit the construction of large objects of art such as those found in the entrances of public buildings. The materials from which the pieces are formed and the surface colors may be modified as desired to produce a visual effect such as by the use of different colors for different pieces or by placing letters, figures, or other designs on the pieces which either alone or combination produce a specific visual impact.

It is also contemplated that the upper and lower surfaces of the pieces need not necessarily be parallel so that slanting of one of the surfaces relative to the other could produce a three dimensional effect even in construction of a two dimensional form such as illustrated in FIG. 9.

Although the foregoing description illustrates the preferred embodiment of the present invention, many variations are possible. All such variations as would be obvious to one skilled in this art are intended to be included within the scope of the invention as defined by the following claims.

What is claimed is:

1. A geometric building and amusement set comprising a plurality of generally equilateral triangularly cross sectioned pieces having substantially flat parallel upper and lower surfaces joined by side surfaces disposed substantially perpendicular to the upper and lower surfaces, the set having three distinctly shaped groups of pieces which can be assembled to form three dimensional geometric figures;

a. a first group of pieces having formed on a first side surface a generally rectangular male connector protruding outwardly therefrom and forming a major widthwise extent of said first side surface and having pivotal joining means formed on opposite ends of the male connector, a generally rectangular female connector recess formed in a second side surface and proportioned to accept a male connector of an adjacent piece and having cooperating pivotal joining means releasably engageable with the corresponding joining means formed on a male connector of an adjacent piece, said joining means comprising a protuberance formed in each end portion of the female connector recess and a corresponding recess formed in each end of the male connector, the protuberances and corresponding recesses forming the pivotal axis of adjacent connected pieces and so formed as to permit at least 180° of relative rotation, and a third continuously flat side surface free of functional discontinuities therein and of any means for interconnecting with other pieces;

b. a second group of pieces formed with only said male connector on one side surface and the remaining side surfaces being continuously flat and free of functional discontinuities therein and of any means for interconnecting with other pieces; and c. a third group of pieces formed with only the female connector recess on one side surface and the remaining side surfaces being continuously flat and free of functional discontinuities therein and of any means for interconnecting with other pieces.

* * * * *